United States Patent [19]

Culling

[11] Patent Number: 5,077,006

[45] Date of Patent: Dec. 31, 1991

[54] HEAT RESISTANT ALLOYS

[75] Inventor: John H. Culling, St. Louis, Mo.

[73] Assignee: Carondelet Foundry Company, St. Louis, Mo.

[21] Appl. No.: 556,275

[22] Filed: Jul. 23, 1990

[51] Int. Cl.[5] ..... C22C 30/00; C22C 19/05; C22C 38/44; C22C 27/04

[52] U.S. Cl. ..... 420/584.1; 420/586; 420/580; 420/581; 420/583; 420/53; 420/40; 420/430; 420/431; 420/443; 420/451; 420/453; 420/454

[58] Field of Search ..... 420/580, 586, 581, 584, 420/583, 430, 40, 47, 48, 53, 54, 61, 63, 68, 69, 113, 114, 557, 552, 551, 439, 430, 453, 443, 451, 454, 443

[56] References Cited

U.S. PATENT DOCUMENTS

| | | | |
|---|---|---|---|
| 2,857,266 | 2/1958 | Anger | 420/584 |
| 3,150,971 | 9/1964 | Weisert et al. | 420/430 |
| 3,758,294 | 8/1970 | Pompey et al. | 420/584 |

*Primary Examiner*—Deborah Yee

*Attorney, Agent, or Firm*—Seniger, Powers, Leavitt & Roedel

[57] ABSTRACT

This invention relates to heat and corrosion resistant alloys for structural parts in industrial furnaces and similar installations requiring hot strength, long life and resistance to hot gas corrosion, carburization and thermal fatigue, and to master alloys to aid in the production of these alloys. The alloys consist of additions of less than one percent by weight each of the components tungsten, zirconium, molybdenum, columbium, titanium and one or more rare earth elements to base alloys of the types standardized by the Alloy Castings Institute Division of the Steel Founders Society of America or to similar base alloys. The master alloys consist of all of these components, with the possible exception of Mo, combined together in the desired proportions, possibly along with some combination of iron, nickel or chromium in total content of up to about half of the master alloys by weight as partial diluents. The resultant master alloys are always denser than molten baths of the base heat resistant alloys.

29 Claims, No Drawings

HEAT RESISTANT ALLOYS

BACKGROUND OF THE INVENTION

Parts for industrial furnaces and similar installations need to be made from alloys of moderate cost yet require one or more of the properties of resistance to hot gas corrosion, carburization, thermal fatigue or thermal shock failure, along with hot strength and the capability of being melted and poured in air. These parts have mostly been produced from alloy compositions standardized by the Alloy Castings Institute (ACI) Division of the Steel Founders Society of America and designated by an H followed by one other letter to differentiate between types. By far the most widely employed of these ACI alloys have been the HH type with nominal contents of about 25% Cr and 12% Ni and the HK type, nominally containing about 25% Cr and 20% Ni. When rapid or repeated thermal cycling was to be encountered in service, the HT type of about 35% Ni and 16% Cr was often employed. Most of the other ACI-type alloys have been very much less employed.

All of the ACI-type alloys have only moderate hot strength, but type HP, of about 35% Ni and 25% Cr content, combines good hot gas corrosion resistance with greater hot strength than any of the other ACI-types. Still, there have been ever increasing needs for alloys of even greater hot strength, and, in some instances, for further improvement in hot gas corrosion resistance or carburization resistance.

Efforts to answer these needs have resulted in the development of various modifications of standard ACI-type alloys. The most widely modified ACI alloy has been type HP, which has been altered by additions of about 1% to 5% W, and sometimes increases in nickel content up to about 48%, alternatively with about 15% Co, yielding a nickel plus cobalt content of about 48%. Some modifications employ increased chromium content to about 28%, while other modifications also employ one or more of each of columbium, molybdenum or titanium in amounts of about 2% or less. Unfortunately, alloys containing nickel plus cobalt in amounts up to a total of 48% along with about 5% W suffer from a significant increase in cost. There has, therefore, been considerable effort directed toward development of ACI-type alloys which are strengthened and improved by relatively small additions of component elements from the group W, Mo, Cb, Zr, Ti, Al, V, Ca, N, B, Mg, Ta, Th, Be, Cu, and Ce or some combination of rare earth elements in place of Ce. Such additions, when employed in quantities of the order of less than about 1% each by weight have come to be called microalloy additions.

In addition to the efforts to improve the hot strength of ACI-type alloys many alloys having excellent hot strength have been developed for applications in aircraft gas turbine engines, with rotary blade and stator vane materials in the turbine stage presenting the most demanding requirements. Such alloys are almost entirely produced in vacuum or inert gas atmospheres and contain large total quantities of relatively scarce and expensive elements. However, the maximum hot strength of these alloys is obtained with resultant sacrifice in ductility, machinability, weldability and hot gas corrosion resistance. In general, these alloys are far too costly and not well suited for industrial furnace parts.

Other alloys containing from about 33% to about 60% Cr by weight have been developed either to extend operating temperatures up to 2200° F. to 2400° F. or to provide resistance to particularly corrosive gases containing compounds of such elements as vanadium, sodium and sulfur. In order to achieve maximum hot corrosion resistance, however, these alloys have sacrificed other properties and suffer from one or more of the very undesirable characteristics of low hot strength, greatly increased costs, excessive brittleness and poor fabricability, weldability, formability and foundry properties. They represent the opposite end of the spectrum of properties from the gas turbine alloys.

As is known to those in the art, there is no perfect alloy for all heat resistant applications. Every alloy represents a compromise of properties and of constituent elements, but the most desirable alloys for industrial furnace parts and similar applications require both high hot strength and high hot gas corrosion resistance along with moderate cost and long service life.

By 1940, many workers in the heat resistant alloy field had reported improvements in the hot gas corrosion resistance of heat resistant alloys brought about by additions of the order of a half percent or less of such elements as calcium, magnesium, zirconium, thorium and cerium or other rare earth elements, which are often supplied commercially in a mixture called mischmetal. These additions improved the protective surface coatings of the alloys which naturally form in the presence of oxygen, and refined the grains of the alloys.

Post, et al, U.S. Pat. No. 2,553,330, discloses improvements in the hot workability of virtually all corrosion and heat resistant alloys by the addition of about 8 to 12 pounds per ton of molten metal of cerium, lanthanum or other rare earth elements. Since these elements float on the surface of the molten bath and readily oxidize in air, Post's additions were said to result in recoveries in the final solid metal of only about 0.14% to about 0.32% by weight of rare earth elements. Post also teaches that recovery of substantially larger amounts of cerium and other rare earth metals results in deterioration in fabricability to levels below those of the original alloys without any rare earth metal addition.

Scharfstein, U.S. Pat. No. 3,168,397, claims benefits in corrosion resistant alloys by the addition of about 0.1% to about 0.3% of rare earth elements to the final metal.

Heyer, et al, U.S. Pat. No. 4,077,801, discloses substantial improvements in hot strength of ACI-type alloys by the addition of about 0.5% W and about 0.3% Ti, along with the possible inclusion of columbium (niobium). These alloys are marketed by the Manoir Electralloys Corporation, formerly by the Abex Corporation, under the trade name Thermax.

Japanese patent J6 0059-051A describes what is essentially the ACI HP alloy base plus 0.5 to 3% W, 0.2 to 0.8% Mo, 0.3 to 1.5% Cb, 0.04 to 0.5% Ti, 0.02 to 0.5% Al and small amounts of B and N. An examplary alloy contains nominally 1% Cb, 1% W, 0.4% Mo, 0.15% T, 0.15% Al, 0.08% N and 0.002% B. This alloy is then subjected to "coating" under controlled conditions to diffuse large amounts of aluminum into the "skin" of the alloy. Typically, when ready to go into service, this alloy will contain from about 0.3% to about 0.8% Al within the first millimeter of surface depth and about 0.15% to about 0.4% Al in the layer from 1 mm to 2mm depth. The resultant alloy is said to have excellent resistance to heat and carburization. While the alloy in this patent is said to contain large quantities of molybdenum, tungsten, columbium and titanium without pronounced tendency to form other matrix phases that shorten service life, such amounts of these elements would be too much for the HF, HH, HI, HK and HL types of ACI alloys, all of which are only borderline stable, with their standard nickel and chromium contents, before any other ferrite-forming elements are added. Also this Japanese patent specifies additions of aluminum, another very strong ferritizing element which would further tend to destabilize these alloys having borderline stability.

Present day nickel-base superalloys do not contain any appreciable quantities of carbon and derive their hot strength by formation of precipitates from the solid solution matrix of nickel-aluminum-titanium compounds, referred to as gamma-prime phase. These alloys may contain up to 8% Al and up to 5% Ti. Since both of these elements are readily oxidized at molten alloy temperatures in air, all such alloys are produced in vacuum or some inert gas atmosphere.

Aluminum and all of the carbide forming elements, chromium, molybdenum, tungsten, cobalt, titanium, zirconium, hafnium, tantalum and vanadium oppose, or destabilize in various degrees, the desired austenitic, or face-centered-cubic, crystal matrix structure of these alloys. Thus, when these elements are present in sufficiently large amounts in aggregate they cause formation of such non-austenitic phases, either in production or in service, as alpha, delta, sigma, laves, mu or others, all of which lead to early loss of hot strength and failure in service.

Nickel, cobalt, carbon, nitrogen and manganese all tend to promote or maintain the desired austenitic matrix of these alloys. Therefore, increasing amounts of the so-called ferrite-formers mentioned above may to some extent be offset by increasing amounts of the austenite-formers. But, there are numerous limitations. For example, nickel is moderately expensive, and many of the ACI-type alloys contain as little as 8% Ni and, usually, large amounts of iron. Cobalt may partially substitute for nickel in this role, but it is considerably scarcer than nickel and generally much more expensive.

Manganese and nitrogen have been employed, often as partial nickel substitutes in corrosion resistant alloys, which operate at or near room temperatures. A high manganese content is generally detrimental to hot strength of heat resistant alloys, and manganese is limited to about 2% maximum as a deoxidizing component in ordinary steelmaking practice. While nitrogen has beneficial effects upon corrosion resistance in certain media, it is less beneficial than carbon in developing hot strength in heat resistant alloys. Since both nitrogen and carbon in large amounts reduce ductility and weldability, carbon is primarily chosen for strengthening corrosion resistant super alloys.

Chromium is required in ACI-type and similar alloys to provide resistance to oxidation in air or in other typical service atmospheres. Nickel is of some benefit in this regard for most of the hot gases typically encountered, so that a somewhat lower chromium content may be tolerated in alloys of very high nickel content. For example, type HF alloy begins to scale badly above about 1650° F, while type HT, of higher nickel but slightly lower chromium content than type HF, resists scaling to about 1950° F. While nickel is much more expensive than chromium, alloys of high nickel content are nevertheless employed because of their increased hot strength. It is not cost effective to attempt to reduce chromium by increasing nickel in the desire for only better hot gas corrosion resistance. It is more cost effective to employ high Cr to Ni ratios if hot gas corrosion resistance is mainly required at lower hot strengths. If hot strength is also an important factor in a given application, somewhat higher Ni to Cr ratios may be employed to attain the same level of hot gas corrosion resistance.

It is therefore seen that in ACI-type alloys cobalt, manganese, carbon and nitrogen all have certain practical limits, and so therefore do the possible combinations and amounts of the ferrite-forming elements from which increased hot strength is derived.

Some alloys produced early in the development of super alloys for the gas turbine and turbo jet industries are listed in Table I.

TABLE I

| | WEIGHT % OF ELEMENTS | | | | | | |
|---|---|---|---|---|---|---|---|
| DESIGNATION | Ni | Cr | Co | Mo | W | Cb | Ti |
| S-495 | 20 | 15 | — | 4 | 4 | 4 | — |
| S-497 | 20 | 15 | 20 | 4 | 4 | 4 | — |
| S-590 | 20 | 20 | 20 | 4 | 4 | 4 | 15 |
| S-816 | 20 | 20 | 45 | 4 | 4 | 4 | — |
| N-153 | 15 | 16 | 13 | 3 | 2 | 1 | — |
| N-155 | 20 | 20 | 20 | 3 | 2 | 1 | 0.25 |
| U.S. Pat. No. 2,416,515 | 9 | 19 | — | 1.4 | 1.4 | 0.4 | 0.25 |
| U.S. Pat. No. 3,127,265 (SUPERTHERM) | 35 | 28 | 15 | — | 5 | — | — |

In the "S" series of alloys, the contents of molybdenum, tungsten and columbium represent substantial additions of ferrite-forming, carbide-forming elements. At 1200° F. for periods up to about 1000 hours, the hot strength of the "S" alloys increases with increasing amounts of nickel and cobalt. However, the first three alloys of Table I were quite unstable and were reduced to about the same much lower strength levels for 1000 hour periods at 1350° F. Only the S-816 alloy, of much higher total nickel and cobalt content, was found to be sufficiently stable metallurgically over longer periods of time to continue in use.

The N-153 and N-155 alloys were of lower molybdenum, tungsten and columbium content, but the N-153 alloy still contained too much of these three elements, when coupled with the lower amounts of nickel and cobalt, to be stable over long periods of time even at the reduced chromuim level. The N-155 alloy continued in use for decades for moderately low temperature service of about 1350° F. or less, because it is metallurgically quite well balanced and stable.

Evans, U.S. Pat. No. 2,416,515, is also shown in Table I. That patent discloses an alloy having even lower amounts of molybdenum, tungsten and columbium, along with a small amount of titanium and a very nominal nickel content of 9%. But this low-nickel alloy is still unstable metallurgically even with its much reduced content of ferrite formers. At 1600° F. over periods beyond 1000 hours or at 1500° F. over periods beyond 16 months the '515 alloy has even lower hot strength than the ACI plain HF 30 alloy, which contains none of the four elements, molybdenum, tungsten, columbium and titanium, but is otherwise the same base alloy. In view of the fact that ACI-type alloys are expected to last for years at temperatures generally above 1500°–1600° F. the alloys of Table I, including Evans '515, do not teach quantities of the elements molybdenum, tungsten, columbium and titanium, that are useful in enhancing hot strengths and service lives of ACI-type alloys.

Present day super alloys have been formulated to contain various combinations not only of the above elements, molybdenum, tungsten, columbium and titanium, but also of as much as 0.2% B, 2.5% V, 2.25% Zr, 9% Ta, 2% Re, 0.5% Hf and small amounts of berylium, yttrium or lanthanum. The other elements found in the super alloys are present in various combinations of 0 to 68% Co, 0 to 78% Ni, 3 to 28% Cr, 0 to 17% Mo, 0 to 20% W, 0 to 6% Cb, 0 to 8% Al and 0 to 5% Ti.

More recently Manoir Electroalloys Corporation has produced ACI-type HK and HP alloys, which evidence further improved hot strength as a result of additions of about 0.5% W, 0.25% Cb, 0.10% Ti and some addition of cerium or other rare earth element. These alloys are marketed under the trade names TMA 4700 and TMA 6300 for the improved HK and HP alloys, respectively.

Nevertheless, in spite of these various efforts to provide alloys of increased hot strength, there remains an enormous demand for further improvements in the properties of these alloys. Especially attractive is the attainment of those properties by microalloying due to the attractive low cost for gains in properties in addition to hot strength. Thus, it is particularly desirable to achieve even further improvements in hot strength as well as improved hot ductility, weldability and resistance to thermal fatigue and thermal shock, without sacrifices in machinability or foundry properties.

SUMMARY OF THE INVENTION

Among the several objects of the present invention, therefore, may be noted the provision of improved heat resistant alloys of the ACI-type or similar type by the microalloying additions of the elements, tungsten, zirconium, molybdenum, columbium (niobium) and titanium plus an additional component consisting of mischmetal or any of the rare earth elements found in mischmetal either singly or in combination. A further object of the invention is to provide such alloys that have relatively high hot strength and long life in the structural parts of industrial furnaces and in similar installations in which such parts must also possess excellent resistance to hot gas corrosion and to failure by thermal fatigue. Another object of the invention is the provision of such alloys, which, although they can be melted and cast in vacuum or inert gas atmospheres, can be readily produced by ordinary air melting and air casting techniques and equipment without metallurgical detriment.

A further object is to provide such alloys that are relatively low in cost because of their low total critical or strategic element content as compared either to aircraft gas turbine superalloys or to the highly alloyed prior art ACI-type alloys.

A still further object of the invention is to provide master alloys in which tungsten, columbium, titanium and zirconium and one or more of the elements of the rare earth group are all combined in the solid state in the proportions desired in the final heat resistant alloys, such that these master alloys, which are always denser than the molten base alloy, may be added to any suitable ACI-type or similar base alloy (i.e. alloys of C, Fe, Ni, Co and Cr plus any of the usual elements Mn, Si, P or S, and other impurities) along with the desired additional element molybdenum to produce the heat resistant alloys of the invention. A further object of the invention is to provide master alloys that contain all of the desired alloying elements of the invention, including molybdenum, so that a single addition of such master alloys can be easily made to base alloys to produce heat resistant alloys of the invention. Another object of the invention is to provide either of these types of master alloys which also contain up to about 58% by weight of nickel and/or of iron as partial diluents, and which still contain the other desired addition elements in the proportions desired in the final heat resistant alloys. A further object of the invention is to provide such master alloys, whereby, upon their addition to base alloy, they carry all of the desired elements to the bottom of the molten bath, where they lie until dissolved in isolation from the air at the top surface of the bath.

Briefly therefore, the present invention is directed to air-meltable, air-castable, weldable, heat resistant alloys that exhibit high creep rupture strengths and high ductilities. These alloys consist of, by weight, between about 8% and about 62% Ni, between about 12% and about 32% Cr, between about 0.2% and about 0.95% W, between about 0.05% and about 0.8% Zr, between about 0.05% and about 0.8% Mo, between about 0.05% and about 0.6% Cb, between about 0.05% and about 0.45% Ti and between about 0.04% and about 0.4% of a rare earth component, such as mischmetal, cerium, lanthanum, or of any combination of one or more rare earth elements, and the balance essentially iron. The instant alloys can also contain up to about 3% Si, up to about 0.05% B, up to about 0.3% V, up to about 3% Mn, up to about 0.8% C, up to about 0.4% N and up to about 25% Co. In this regard, later work has shown that as large plant melts are employed, compared to my earlier work work in developing the alloys of the invention, greater losses of the rare earth metals or misch metal were experienced. While the cause of this problem is undoubtedly due to many factors, such as longer holding times at high temperatures in the larger melts and the use of lower cost sources of iron which contain more impurities and the use of scrap and sprue which tends to recycle oxygen and nitrogen. This later work has also shown that this problem can be overcome by using larger quantities of rare earths/misch metal in some alloys. The use of these higher levels of rare earths/misch metal insures the maximum improvement in ductility, weldability and service life of the alloys of the invention.

The ACI-type and similar alloys of this invention can generally be produced in ordinary air and derive their hot strengths primarily by formation of carbides, not gamma prime precipitates.

The present invention is also directed toward master alloys, or alloy concentrates, in which either tungsten or tungsten and molybdenum are combined with all of the light elements of the group, columbium, zirconium, titanium, and a rare earth component, in such proportions The master alloys therefore consist of, by weight, between about 24% and about 47% W, between about 10% and about 23% Cb, between about 8% and about 21% Mo, between and about 21% Zr, between about 8% and about 13% Ti, and between about 5% and about 35% rare earth component. Master alloys which are not formulated with the inclusion of molybdenum consist of, by weight, between about and about 51% W, between about 13% and 27% Cb, between and about 25% Zr, between about 9% and about 15% Ti, and between about 7% and about 40% rare earth component.

DESCRIPTION OF THE PREFERRED EMBODIMENT

The essential components of heat resistant alloys of the invention are:

Nickel: 8% to 62% by weight
Chromium: 12% to 32%
Tungsten: 0.2% to 0.95%
Zirconium: 0.05% to 0.08%
Molybdenum: 0.05% to 0.8%
Columbium: 0.05% to 0.6%
Titanium: 0.05% to 0.45%
Rare Earth Component: 0.04% to 0.40%
Iron: essentially balance In addition, the alloys of the invention will nominally contain up to about 0.8% by weight carbon. The nitrogen content is ordinarily the amount absorbed from the air during melting and pouring. However, for sound castings, nitrogen must not exceed its solid solubility limit and is held to a maximum of about 0.4% in alloys of the invention.

The alloys of the invention may also contain:

Silicon: up to about 3% by weight
Vanadium: up to about 0.3%
Manganese: up to about 3%
Cobalt: up to about 25%
Boron: up to about 0.05%

Master alloys of the invention contain either all six of the essential components, W, Cb, Mo, Ti, Zr and a rare earth component or all but Mo, along with residuals. The residuals may include those elements which are not harmful to the final alloys of the invention in the quantities encountered and which may be included by virtue of their possible presence in either relatively pure or somewhat diluted raw materials suitable for master alloy production. It would be unnecessary and more costly to attempt to produce such master alloys from completely pure raw materials.

The residuals that might thus be encountered would likely include several of the group, iron, nickel, chromium, cobalt, manganese, silicon, carbon, tantalum, sulfur, phosphorus, aluminum, calcium, magnesium, copper, vanadium, tin, lead, bismuth, barium, nitrogen, oxygen, thallium, tellurium, selenium, antimony and even a small amount of molybdenum in those master alloys in which the final molybdenum content is intended to be obtained by a separate source of molybdenum addition. Most of these elements might be present in quantities ranging from about a tenth of a percent of the master alloys compositions down to less than about five parts per million by weight. Iron and/or nickel would ordinarily comprise the largest portion of the residuals. Thus the alloy concentrates of the invention consist of, by weight percentages, the proportions as given in Tables A and B.

TABLE A

| COMPOSITION OF MASTER ALLOYS - LOW RESIDUALS | |
|---|---|
| Mo-CONTAINING | Mo-FREE |
| 24%-47% W | 30%-51% W |
| 10%-23% Cb | 13%-27% Cb |
| 8%-21% Mo | 9%-25% Zr |
| 9%-21% Zr | 9%-15% Ti |
| 8%-13% Ti | 7%-40% Rare earth |
| 5%-35% Rare earth | Balance residuals |
| Balance residuals | (Density - 8.18-9.6 gm/cc) |
| (Density - 8.4-9.8 gm/cc) | |

The broad ranges of components of master alloys set forth above in Table A is for molybdenum-bearing and molybdenum-free master alloys in the relatively pure state. Obviously, not all essential elements can be present in each master alloy in their maximum permissible amounts. That is, when one or more of the components are present at the maximum end of their permissible ranges, one or more of the other components must be reduced in order that all components total only one hundred percent. Actually, the essential components will ordinarily never exceed a total about 95% to 97% even for relatively pure master alloys, because it is virtually impossible at reasonable or practical costs not to accumulate about three to five percent by weight of impurities from furnace linings or other sources.

Table B, below, sets forth the broad ranges, by weight, of essential components in the master alloys which, for cost or convenience reasons, might include up to about half of their contents in iron, nickel and other residuals.

TABLE B

| COMPOSITION OF MASTER ALLOYS- HIGH RESIDUALS | |
|---|---|
| Mo-CONTAINING | Mo-FREE |
| 12%-24% W | 16%-26% W |
| 6%-11% Cb | 7%-13% Cb |
| 4%-10% Mo | 4%-12% Zr |
| 4%-10% Zr | 4%-8% Ti |
| 4%-6% Ti | 3%-20% Rare earth |
| 3%-17% Rare earth | Balance residuals |
| Balance residuals | (Density - 8.15-8.4 gm/cc) |
| (Density - 8.16-8.8 gm/cc) | |

It is not desirable for master alloys to be formulated so as to include substantially greater than half of their contents as residuals because of such practical considerations as temperature drop of the molten bath when huge cold additions are made near the end of the melting process. Also, larger quantities of residuals tend to complicate the charge making process in some of the variations of ACI H-type alloys or of similar alloys. However, it would be quite practical to produce master alloys in which the residuals would total somewhat more than 3% to 5% but a lot less than 58%. In such cases, the master alloys would obviously contain the essential components in ranges proportionately spaced in between the extremes given in Tables A and B.

Thus, preferred master alloys consist of, by weight, are given in Table C.

TABLE C

| Mo-CONTAINING | Mo-FREE |
|---|---|
| COMPOSITION OF MASTER ALLOYS- LOW RESIDUALS | |
| 26%-44% W | 28%-42% W |
| 14%-23% Cb | 16%-25% Cb |
| 9%-21% Mo | 9%-20% Zr |
| 9%-18% Zr | 9%-14% Ti |
| 8%-12% Ti | 28%-40% Rare earth |
| 20%-36% Rare earth | Balance residuals |
| Balance residuals | (Density - 8.3-9.3 gm/cc) |
| (Density - 8.5-9.5 gm/cc) | |
| HIGH RESIDUALS | |
| 13%-22% W | 14%-21% W |
| 7%-11% Cb | 8%-12% Cb |
| 4%-10% Mo | 4%-10% Zr |
| 4%-9% Zr | 4%-9% Ti |
| 3%-6% Ti | 14%-21% Rare earth |
| 10%-18% Rare earth | Balance residuals |
| Balance residuals | (Density - 8.3-9.0 gm/cc) |

TABLE C-continued

| Mo-CONTAINING | Mo-FREE |
|---|---|
| (Density - 8.4–9.0 gm/cc) | |

The most preferred ranges of components for master alloys, by weight, are given in Table D.

TABLE D

| Mo-CONTAINING | Mo-FREE |
|---|---|
| COMPOSITION OF MASTER ALLOYS-LOW RESIDUALS | |
| 29%–32% W | 33%–35% W |
| 14%–16% Cb | 16%–18% Cb |
| 9%–14% Mo | 9%–11% Zr |
| 9%–13% Zr | 9%–13% Ti |
| 8%–12% Ti | 27%–29% Rare earth |
| 23%–27% Rare earth | 3%–6% Residuals |
| 3%–8% Residuals | (8.3–8.7 gm/cc) |
| (8.5–9.5 gm/cc) | |
| HIGH RESIDUALS | |
| 15%–18% W | 16%–19% W |
| 7%–10% Cb | 8%–11% Cb |
| 4%–7% Mo | 4%–8% Zr |
| 4%–7% Zr | 4%–8% Ti |
| 4%–6% Ti | 16%–19% Rare earth |
| 11%–16% Rare earth | 35%–52% Residuals |
| 36%–55% Residuals | (8.3–8.8 gm/cc) |
| (8.5–9.0 gm/cc) | |

It is also understood that production of the above master alloys, but with the intentional addition of small quantities of carbon, manganese, silicon and/or chromium, still falls within the scope of this invention.

When additions of the relatively pure metals, or of ferro alloys or of nickel alloys of, zirconium, titanium, columbium and rare earth elements, are made to air melted heat resistant alloys, variable losses are encountered due to the fact that these elements are all low density components and are also highly oxidizable at temperatures of the molten base alloys. The recover of these elements thus tends to be somewhat variable, and costs are increased due to oxidation losses. On the other hand, the master alloys of the invention, which combine these light elements with tungsten, or tungsten and molybdenum, the heavier elements of the alloys of invention, are always of higher density than the molten base heat resistant alloys. Thus, the master alloys of the invention will have densities at room temperature of at least about 8.1 gm/cc. The range of densities of the master alloys set forth in Tables A to D are noted in those Tables. Therefore these master alloys, when added to a molten base alloy, carry all of the light, easily oxidizable, elements to the bottom of the molten bath where they remain in isolation from the oxygen in the atmosphere until dissolved. In this system of addition, the losses of the light elements during air melting are negligible. Thus, while the heat resistant alloys of the invention can be prepared without the use of master alloys, they are more easily and cheaply prepared through use of the instant master alloys.

The selection of specific microalloy elements and of their amounts for use in the heat resistant alloys of this invention is dependent upon many metallurgical factors, and deviations from the choice of a particular element and/or the amount employed may detrimentally influence the properties of the final alloys.

Thus, metals in heat service may fail as a result of low temperature behavior or of high temperature behavior. Low temperature behavior is characterized by transcrystalline failure, high strain rates and low diffusion rate, and failure may be caused by thermal shock. High temperature behavior involves intercrystalline failure, low strain rates and high diffusion rates, and failure may be caused by thermal fatigue. Thus at lower temperatures and higher stresses, the grain is the limiting strength component whereas the grain boundary is the weak component at lower stresses and higher temperatures. For example, titanium and columbium form carbides primarily within the metallic grains. Zirconium is also a carbide former, but its most important effects are at the grain boundaries, where it increases the boundary ductility and tends to fill lattice discontinuities.

I have found that in the amounts of the various alloying elements employed in alloys of the present invention, molybdenum increases stress carrying capacity at lower temperatures and over the shorter term, whereas tungsten increases higher temperature stress carrying capacity over the longer term. Thus the combination of molybdenum, cobalt and titanium, in the amounts present in the invention, opposes failure by low temperature behavior, while the combination of tungsten, columbium and zirconium opposes failure by high temperature behavior.

In the instant alloys hot strength is derived primarily from the presence of fine carbide particles. Chromium carbides in high temperature service tend to coalesce and to lose their strengthening effect in time. However, molybdenum and tungsten both enter into complex chromium carbides. Molybdenum seems to especially retard the growth rate of the resultant complex carbides at the lower end of the temperature range, while tungsten appears to be especially beneficial in retarding chromium carbide transformation due to coalescence at higher temperatures. However, each assists the other in its role.

Titanium on the other hand forms its own carbides which are very fine and slow to change. Columbium also tends to form its own carbides as well as to enter into titanium and zirconium cabides when titanium and zirconium are present, and further retards the rate of change of the resulting carbides.

The primary role of the rare earth component is, for example, to refine the grain, increase workability and retard hot gas corrosion. Thus all of the microalloys of the present invention act together in filling different roles.

My work on improved microallying of base alloys of the invention containing above about 20% Cr has shown that oxidation in air at 2100° F. to 2200° F. is increased substantially by additions of about 0.5% of either molybdenum or columbium. Additions of the same amount of tungsten reduced base-alloy oxidation slightly, while the addition of titanium or zirconium reduced base-alloy oxidation by about one third. The addition of one half percent mischmetal reduced the oxidation of base alloys by about two thirds. The effects at 2000° F were similar, but zirconium had beneficial effects about equal to those of mischmetal. Thus, tungsten, zirconium, titanium and rare earth metals all tend to offset the deleterious effects of molybdenum and columbium on oxidation resistance, and are employed to insure good hot gas corrosion resistance. Therefore, the various elements of the invention have their mutual roles in reducing corrosion as well as improving hot strength.

The preferred and especially beneficial ranges of the ACI-alloy modifying elements of the invention which provide more optimum mechanical, chemical and thermal properties in the entire range of ACI-type or similar alloy bases of the invention are, by weight percentage, as follows:

TABLE II

| ADDITION ELEMENT | MAXIMUM RANGE | PREFERRED RANGE | MOST PREFERRED RANGE |
|---|---|---|---|
| Molybdenum | 0.05%-0.80% | 0.08%-0.60% | 0.08%-0.25% |
| Tungsten | 0.20%-0.95% | 0.20%-0.70% | 0.30%-0.50% |
| Columbium | 0.05%-0.60% | 0.15%-0.50% | 0.15%-0.25% |
| Zirconium | 0.05%-0.80% | 0.08%-0.60% | 0.08%-0.25% |
| Titanium | 0.05%-0.45% | 0.08%-0.30% | 0.08%-0.20% |
| Rare Earth Component* | 0.04%-0.40% | 0.05%-0.30% | 0.05%-0.30% |

*This may be in the form of mischmetal or any combination singly or together of any rare earth element.

The present invention provides for the addition of elements from the above list, as discussed above, which, when combined in the correct proportions and quantities, and employed in ACI-type and similar alloy bases, produces higher hot strengths over longer periods of time in such alloys than any prior art modification of such alloys. Nevertheless, the alloys of the invention maintain excellent weldability, machinability, ductility and resistance to thermal shock or thermal fatigue failures as well as to oxidation or other hot gas corrosion. The quantities and proportions of such elements employed in the instant alloys are such that they do not damage the austenitic matrices by destabilizing them in service and thereby causing early loss of properties. Further, the present invention accomplishes these results with such small quantities of relatively non-critical elements that the final cost of producing the alloys of the invention is only slightly increased above the cost of the base alloys themselves.

Master alloys of the invention may be prepared by combining all of the elements of Table II except molybdenum or all six of the elements listed. In either event the elements will be present in the proportions given in Table II, optionally containing, as diluent elements, iron, nickel and/or chromium (all of which are present in the alloys of the invention) in a total amount that comprises up to about half or less of the total weight of the essential elements. In all instances, whether such master alloys are comprised of only the essential elements plus trace amounts of other impurities or of those elements in the same proportions but diluted by up to their total weight by the diluent elements referred to, the resultant master alloys have a higher density than the molten alloy bases to which they are to be added. Also, it is generally easier and less costly to prepare master alloys where it is permissible, as in the present invention, to include modest amounts of impurities (such as, Al, Ca, Mg, Cu, Ba, Co, V, S, and P).

There are advantages to both the molybdenum-containing and the molybdenum-free type master alloys. In the case of the former, all essential ingredients of the invention may be readily and easily added to the molten bath as one addition agent, and all of these six essential ingredients would be in appropriate proportions. In the case of the latter approach, the master alloy is slightly easier to prepare, and all of the desired components but molybdenum would be made as one low loss addition. In any event, it is possible to make a master alloy of about 30% W, 10% Mo, 15% Cb, and 10% each of Zr and Ti and 25% of a rare earth component, all by weight percentages. It is equally possible to make the desired master alloy by weight of 33% W, 17% Cb, 9% Zr, 11% Ti and 27% of a rare earth component.

In the event that the master alloy does not contain molybdenum the resultant master alloy will still sink to the bottom of the melt until dissolved, and the molybdenum addition may be made separately as metallic or as a molybdic oxide form or some other form since the oxide of molybdenum is not stable at melt temperatures and reverts to the metallic form and is dissolved in the melt without significant loss.

Master alloys containing iron, nickel and/or chromium could, for instance, be composed by weight of approximately 15% W, 6% Mo, 9% Cb, 5% of each of Ti and Zr, 15% of a rare earth component and 45% Fe. Another example might be a master alloy of about 18% W, 9% Cb, 5% Ti, 5% Zr and 15% of a rare earth component and 48% Ni. The five primary or essential elements would be in the correct proportions of these elements in the final production alloy.

Included as permissible impurities in the master alloys of the invention are small quantities of manganese, silicon and aluminum, in as much as all three of these elements are normal deoxidizing agents employed in common steel making practice. The silicon and aluminum content must be kept to low proportions in the master alloy, since they are both of very low density and would defeat the purpose of the master alloy if present in such sufficient quantities as to reduce the master alloy density to the point that pieces or grains of it would no longer sink to the bottom of the molten alloys. Manganese presents less of a problem of this nature because its density is closer to those of iron, nickel and chromium. However, the manganese content of the master alloy should not be so high that it comes close to the desired amount in the final melt, because this presents steelmaking problems in certain air melting procedures and because some manganese will normally be present in various scraps and other melting components. Therefore, it is desirable that the master alloy contain no more than about 10% Mn, no more than about 8% Si and no more than about 4% Al. It is preferable that these elements would be present in lesser amounts in each instance, for example, on the order of 1% or less of each, but the essential characteristics of the master alloy are its density greater than about 8.1 gm/cc and its content of the five or six essential elements of the invention in correct proportions to each other as desired in the final alloys.

Of the other elements sometimes encountered in the most exotic super-alloys, rhenium, is about as scarce as platinum and therefore not practical for this invention even as a fraction of a per cent addition. Hafnium, is somewhat similar in lack of general availability, and theoretical considerations strongly suggest that it would behave somewhat like zirconium. Tantalum, which is also moderately scarce and expensive, behaves in the instant alloys like columbium but is required in twice the quantities of columbium due to its higher atomic weight. Beryllium is extremely toxic as a solid element, a compound or a vapor, and not safe for ordinary foundry production methods. Boron can be added to alloys of the invention, in an amount up to about 0.05%, to improve hot strength and fabricability. In the case of the cobalt-containing alloys of the invention it has been found that the addition of boron in an amount up to about 0.035% provides increased rupture life. In the case of the ACI-H type alloys of the invention it was noted that boron additions of the same magnitude provided variable results with respect to increasing rupture life. Additions of over 0.05% to the ACI-type alloys of the invention was found to be detrimental to strength and ductility.

Vanadium is sometimes employed in certain corrosion resistant alloys which operate near room temperature. It has also been used in high speed tool steels as well as in a few nickel-base superalloys. In alloys in which vanadium was substituted for columbium, but which were otherwise in accordance with the invention, rupture life over the full temperature range was drastically reduced. Alloy HP-849 is an example of this effect.

When vanadium was included along with all of the other six essential addition components of the invention in amounts below about 0.3%, rupture lives at temperatures up to about 1800° F. were often increased while rupture lives above this temperature were lowered as compared to vanadium-free alloys of the invention. Alloys of greater than about 0.3% V, but otherwise in accordance with the inventions, tend to suffer decrease in rupture life at all temperatures. Alloy HP-854 is an example of this phenomenon.

A titanium content greater than about 0.45% in alloys otherwise of the invention causes erratic results; sometimes rupture life and ductility are not damaged by higher contents, but sometimes they drop considerably. This effect may be due to the tendency for large amounts of titanium to produce a dross and resultant defects during air melting.

Mischmetal or any combination of rare earth elements all appear to behave in the same manner in alloys of the invention. Ductility and rupture life drop considerably in alloys of the invention when the maximum of about 0.3% is exceeded. The misch metal employed for the data reported herein had a cerium+lanthanum content of 73% and had a total rare earth content of 97.5%. In practice it has been found that to achieve a desired rare earth elements content in an alloy of the invention it may be necessary to add up to about 60% excess misch metal (based on Ce+La content) to achieve that content.

The following examples further illustrate the invention:

EXAMPLE 1

Heats of several different alloys were prepared in accordance with the invention by adding small quantities of molybdenum, tungsten, columbium, zirconium, titanium and mischmetal to otherwise basic ACI-type (HF, HH, HK, HN and HP) alloys. Well-risered standard ASTM test bar keel blocks were cast from each heat. The composition of these alloys is set forth in Table III, with the balance in each instance being essentially iron. Heat numbers beginning with HF, HH, HK, HN and HP refer to the ACI H-type base alloy employed.

TABLE III

| HEAT NO. | ALLOYS OF THE INVENTION COMPOSITION BY WEIGHT PERCENTAGES | | | | | | | | | | | |
|---|---|---|---|---|---|---|---|---|---|---|---|---|
| | Ni | Cr | Mo | W | Cb | Zr | Ti | REE[1] | Mn | Si | C | N |
| H-871[2] | 35.3 | 28.0 | .15 | .78 | .43 | .19 | .21 | .08 | .64 | .78 | .44 | .02 |
| H-873[3] | 22.8 | 23.1 | .16 | .51 | .46 | .21 | .20 | .09 | .62 | .56 | .45 | .05 |
| HP-823 | 36.9 | 23.8 | .53 | .67 | .46 | .51 | .16 | .08 | .53 | .88 | .55 | .23 |
| HP-832 | 37.0 | 24.1 | .53 | .56 | .53 | .55 | .19 | .08 | .21 | .62 | .57 | .07 |
| HP-834 | 36.8 | 24.3 | .61 | .68 | .56 | .58 | .20 | .07 | .26 | .59 | .54 | .05 |
| HP-835 | 36.9 | 24.8 | .31 | .54 | .29 | .33 | .21 | .12 | .23 | .79 | .50 | .03 |
| HP-836 | 36.1 | 26.0 | .25 | .49 | .28 | .30 | .23 | .12 | .14 | .99 | .46 | .18 |
| HP-839 | 35.9 | 24.1 | .28 | .53 | .41 | .21 | .15 | .13 | .21 | .54 | .49 | .04 |
| HP-840 | 35.9 | 24.0 | .36 | .51 | .48 | .26 | .19 | .15 | .17 | .77 | .36 | .23 |
| HP-851 | 37.0 | 23.3 | .13 | .23 | .17 | .15 | .19 | .05 | .55 | .69 | .44 | .11 |
| HP-852 | 37.2 | 23.8 | .31 | .54 | .36 | .27 | .21 | .09 | .56 | .53 | .45 | .09 |
| HP-855 | 37.1 | 23.2 | .14 | .41 | .20 | .11 | .12 | .08 | .55 | .60 | .45 | .06 |
| HK-826 | 21.9 | 25.0 | .33 | .93 | .51 | .28 | .14 | .13 | .62 | .51 | .47 | .20 |
| HK-837 | 23.2 | 25.4 | .27 | .58 | .28 | .21 | .13 | .15 | .61 | .65 | .45 | .21 |
| HK-841 | 21.9 | 24.8 | .33 | .56 | .25 | .31 | .11 | .08 | .55 | .53 | .42 | .03 |
| HK-842 | 21.9 | 24.8 | .30 | .51 | .33 | .26 | .14 | .09 | .48 | .57 | .47 | .05 |
| HK-843 | 21.8 | 25.1 | .27 | .49 | .31 | .34 | .12 | .08 | .62 | .49 | .41 | .06 |
| HP-844 | 14.3 | 24.1 | .32 | .61 | .28 | .36 | .18 | .13 | .57 | .85 | .42 | .12 |
| HP-845 | 13.9 | 24.9 | .26 | .55 | .27 | .37 | .11 | .15 | .63 | .56 | .38 | .14 |
| HP-846 | 13.7 | 24.6 | .27 | .56 | .25 | .34 | .12 | .12 | .77 | .54 | .39 | .07 |
| HP-847 | 14.0 | 24.0 | .35 | .48 | .23 | .26 | .15 | .12 | .81 | .61 | .44 | .03 |
| HP-848 | 14.1 | 24.9 | .24 | .51 | .21 | .29 | .12 | .13 | .39 | .59 | .41 | .08 |
| HP-861 | 12.1 | 21.3 | .26 | .43 | .25 | .17 | .15 | .07 | .64 | .56 | .31 | .09 |
| HN-862 | 25.6 | 22.1 | .38 | .53 | .31 | .22 | .16 | .08 | .61 | .69 | .42 | .11 |

[1]REE = rare earth elements. Amount reported is 1.33 times the determined amount of Ce + La.
[2]H-871 also contains 14.5% Co.
[3]H-873 also contains 18.9% Co.

Heats of several comparative alloys not of the invention were also prepared and cast into standard test bar keel blocks. The composition of these alloys is set forth in Table IV, with the balance in each instance being essentially iron.

TABLE IV

| HEAT NO. | ALLOYS NOT OF THE INVENTION COMPOSITION BY WEIGHT PERCENTAGES | | | | | | | | | | | |
|---|---|---|---|---|---|---|---|---|---|---|---|---|
| | Ni | Cr | Mo | W | Cb | Zr | Ti | REE[8] | Mn | Si | C | N |
| H-807 | 28.7 | 24.1 | — | 2.2 | 1.50 | .04 | — | — | .59 | .61 | .39 | .24 |
| H-808 | 32.3 | 24.4 | — | 3.78 | — | .39 | — | — | .49 | .48 | .41 | .20 |
| H-810 | 33.7 | 28.8 | — | 3.90 | — | .40 | — | — | .85 | .80 | .41 | .24 |
| HP-820 | 35.5 | 25.1 | .54 | .66 | 57 | .35 | — | — | .82 | .81 | .59 | .21 |

TABLE IV-continued

| HEAT NO. | ALLOYS NOT OF THE INVENTION COMPOSITION BY WEIGHT PERCENTAGES | | | | | | | | | | | |
|---|---|---|---|---|---|---|---|---|---|---|---|---|
| | Ni | Cr | Mo | W | Cb | Zr | Ti | REE[8] | Mn | Si | C | N |
| H-821 | 35.6 | 25.6 | — | 3.66 | .52 | .65 | .03 | — | .87 | .97 | .56 | .18 |
| HK-824 | 20.3 | 25.0 | — | 1.24 | .50 | .42 | — | — | .62 | .50 | .45 | .20 |
| HK-825 | 20.0 | 24.9 | — | .52 | .53 | 2.10 | — | .15 | .63 | .49 | .47 | .26 |
| HK-827[1] | 19.9 | 29.0 | — | .86 | .46 | .80 | — | — | .81 | .67 | .41 | .19 |
| HP-838 | 345.9 | 27.7 | .31 | 3.88 | .33 | .32 | .13 | .07 | .85 | .89 | .40 | .06 |
| CHSX-9[2] | 30.3 | 25.2 | — | 4.13 | 1.02 | .36 | — | — | .56 | .58 | .45 | .21 |
| CHSX-10 | 51.9 | 36.8 | — | 5.16 | — | 0 | 0 | 0 | .43 | .41 | .75 | .20 |
| HP-849[3] | 36.1 | 27.1 | .21 | .51 | .02 | .30 | .10 | .15 | .14 | .88 | .48 | .03 |
| HP-850 | 37.2 | 23.3 | — | .49 | .27 | — | .11 | .08 | .54 | .60 | .44 | .09 |
| HP-853[4] | 38.2 | 24.2 | .77 | 1.58 | .87 | — | .25 | — | .63 | .77 | .49 | .08 |
| HP-854[5] | 37.0 | 22.5 | .25 | .68 | .33 | .20 | .10 | .07 | .68 | .56 | .48 | .07 |
| HP-864 | 36.8 | 24.0 | — | .56 | .29 | — | .12 | .09 | .56 | .95 | .46 | .07 |
| HK-866 | 21.3 | 24.6 | — | .51 | .24 | — | .11 | .08 | .52 | .87 | .43 | .11 |
| HK-867 | 20.7 | 24.3 | — | .54 | .28 | — | .09 | .08 | .61 | .91 | .41 | .14 |
| HP-869[6] | 38.3 | 22.1 | — | .56 | .35 | .23 | .21 | .09 | .64 | 1.12 | .48 | .03 |
| 3001 | 20.1 | 25.0 | .52 | .51 | .50 | — | — | — | .82 | .13 | .49 | .06 |
| 3002 | 20.1 | 25.2 | 1.02 | 1.49 | .26 | — | — | — | .81 | .67 | .47 | .07 |
| 3003 | 20.2 | 26.2 | .82 | .41 | .30 | — | — | — | .77 | .72 | .48 | .04 |
| 3010 | 12.8 | 24.8 | .58 | .49 | .43 | — | — | — | 1.215 | .33 | .47 | .11 |
| 3011 | 13.0 | 25.6 | .86 | .43 | .28 | — | — | — | 1.09 | .46 | .49 | .12 |
| U.S. Pat. No. 3,127,265[7] | 35.7 | 28.1 | — | 5.06 | — | — | — | — | .36 | .67 | .51 | .09 |
| (SUPERTHERM) | | | | | | | | | | | | |
| N-155 | 20.2 | 20.1 | 3.06 | 2.12 | 1.08 | — | .26 | — | .72 | .57 | .14 | .12 |

[1]HK-827 also contains 2.99% Co.
[2]CHSX-9 contains 3.07% Co.
[3]HP-849 contains 0.31% V.
[5]HP-853 also contains 0.026% Al and 0.0031% B.
[6]HP-869 also contains 0.035% B.
[7]SUPERTHERM also contains 15.1% Co.
[8]N-155 also contains 20.2% Co.
[8]REE = rare earth elements. Amount reported is 1.33 times the determined amount of Ce + La.

Standard ASTM creep-rupture test bars were machined from each block and tested at various stresses in ordinary commercial creep rupture frames until rupture. The results from these tests of HP-base alloys of the invention, as well as of alloys not of the invention are set forth in Tables V, VI, VII, and VIII. In all of the tables below the results from alloys of the invention are set forth above the dashed lines while those of comparative alloys are set forth below those lines.

TABLE V

| ALLOY NUMBER | HP TYPE ALLOYS, HOURS TO FAILURE AT 1600° F. UNDER VARIOUS STRESSES | | | | |
|---|---|---|---|---|---|
| | STRESS, P.S.I. | | | | |
| | 14,000 | 12,000 | 10,000 | 9,000 | 8,000 |
| HP-823 | 88.7 | 186.5 | 605.1 | 1183.1 | — |
| HP-832 | — | — | 502.7 | — | — |
| HP-834 | — | 128.6 | 497.4 | 1396.6 | — |
| HP-835 | — | — | 604.3 | — | — |
| HP-836 | 61.6 | 144.2 | 676.9 | — | — |
| HP-839 | 79.8 | 169.8 | 643.2 | — | — |
| HP-840 | 75.3 | 133.4 | 567.7 | — | — |
| HP-851 | — | 129.3 | 516.2 | — | — |
| HP-852 | 167.3 | 201.2 | 657.3 | 1414.3 | — |
| HP-855 | 159.4 | 206.2 | 671.2 | 1511.4 | — |
| HP-850 | — | 137.8 | 287.7 | 674.0 | — |
| HP-864 | — | 107.8 | 343.1 | — | 114.3 |
| THERMAX HP | — | — | 503 | — | — |
| ACI-HP | — | — | 100 | 210 | — |
| H-810 | — | — | 65.6 | 179.5 | — |
| H-820 | 37.1 | 68.2 | 464.4 | 1026.1 | — |
| H-821 | 25.3 | 71.3 | 468.1 | 1161.3 | — |
| H-838 | — | — | 253.6 | 508.2 | — |
| CHSX-9 | 16.3 | 55.2 | — | 491.1 | — |
| HP50WZ | — | — | 179.5 | — | — |
| HP-849 | — | — | — | 60.4 | — |
| HP-853 | — | — | — | 333.7 | — |
| HP-854 | — | — | — | 440.1 | — |
| HP-869 | 12.2 | 22.7 | 56.3 | 98.8 | — |

TABLE VI

| ALLOY NUMBER | HP TYPE ALLOYS, HOURS TO FAILURE AT 1800° F. UNDER VARIOUS STRESSES | | | |
|---|---|---|---|---|
| | STRESS, P.S.I. | | | |
| | 5,000 | 6,000 | 5,000 | 4,000 |
| HP-823 | — | 483.9 | 1467.3 | — |
| HP-832 | — | 384.3 | — | — |
| HP-834 | 121.2 | — | 1615.0 | — |
| HP-835 | — | 368.7 | — | — |
| HP-836 | — | 515.4 | 1428.6 | — |
| HP-839 | — | 479.1 | 1260.6 | — |
| HP-840 | — | 492.2 | 1531.3 | — |
| HP-851 | 107.4 | 298.8 | — | — |
| HP-852 | — | 551.3 | 1362.7 | — |
| HP-855 | 133.4 | 548.6 | 1551.4 | — |
| HP-850 | 51.2 | — | 647.3 | — |
| HP-864 | 40.8 | — | 482.4 | — |
| THERMAX HP | — | 308 | 1301 | 3092 |
| ACI-HP | — | 90 | 210 | 650 |
| H-810 | — | 28.6 | — | 283.1 |
| H-820 | 57.8 | 219.1 | 548.1 | — |
| H-821 | 65.2 | 194.6 | 714.3 | — |
| H-838 | — | 187.5 | — | 387.8 |
| CH5X-9 | 25.8 | 91.2 | 339.5 | — |
| HP-50W2 | — | 131.6 | 470.4 | — |
| HP-849 | — | — | 15.1 | — |
| HP-853 | — | — | 209.2 | — |
| HP-854 | — | — | 825.1 | — |
| HP-869 | 34.1 | 69.2 | 163.2 | — |

TABLE VII

| ALLOY NUMBER | HP TYPE ALLOYS, HOURS TO FAILURE AT 1900° F. UNDER VARIOUS STRESSES | | |
|---|---|---|---|
| | STRESS, P.S.I. | | |
| | 5,000 | 4,000 | 3,000 |
| HP-823 | — | 937.6 | — |
| HP-832 | — | 733.8 | — |
| HP-834 | 147.9 | — | — |
| HP-835 | 146.4 | 754.0 | — |
| HP-836 | — | 901.2 | — |

TABLE VII-continued

| HP TYPE ALLOYS, HOURS TO FAILURE AT 1900° F. UNDER VARIOUS STRESSES | | | |
|---|---|---|---|
| ALLOY | STRESS, P.S.I. | | |
| NUMBER | 5,000 | 4,000 | 3,000 |
| HP-839 | — | 828.6 | — |
| HP-840 | — | 856.3 | — |
| HP-851 | 139.7 | — | — |
| HP-852 | — | 1424.6 | — |
| HP-855 | 196.5 | 1388.5 | — |
| HP-850 | — | 369.0 | — |
| HP-864 | — | 408.6 | — |
| THERMAX HP | — | — | 3468 |
| ACI-HP | — | 120 | 350 |
| H-810 | — | 52.7 | — |
| H-820 | 112.5 | — | — |
| H-821 | 72.5 | — | — |
| H-838 | — | 336.2 | 908.2 |
| CH5X-9 | 36.9 | — | — |
| HD50W2 | 32.3 | 227.5 | 891.9 |
| HP-849 | — | 55.2 | — |
| HP-853 | — | 140.7 | — |
| HP-854 | — | 167.6 | — |
| HP-869 | 23.2 | 58.4 | — |

TABLE VIII

| HP TYPE ALLOYS, HOURS TO FAILURE AT 2000° F. UNDER VARIOUS STRESSES | | | | |
|---|---|---|---|---|
| ALLOY | STRESS, P.S.I. | | | |
| NUMBER | 4,000 | 3,500 | 3,000 | 2,500 |
| HP-823 | — | 560.2 | 1107.4 | 1754.2 |
| HP-832 | — | — | 653.1 | — |
| HP-834 | — | 214.6 | — | — |
| HP-835 | — | 226.2 | — | — |
| HP-836 | — | — | 701.2 | — |
| HP-839 | — | — | 730.9 | — |
| HP-840 | — | — | 714.3 | — |
| HP-851 | — | 289.7 | — | — |
| HP-852 | — | — | 733.2 | — |
| HP-855 | 164.3 | 317.6 | 729.4 | — |
| HP-850 | — | 104.9 | 213.8 | — |
| HP-864 | — | 122.3 | 287.8 | — |
| THERMAX HP | — | — | 288 | 1056 |
| ACI-HP | — | — | 80 | 150 |
| H-810 | — | 37.3 | — | — |
| H-820 | — | 120.1 | 289.5 | — |
| H-821 | — | 91.6 | 214.6 | — |
| H-838 | — | 101.3 | 156.8 | — |
| CHSX-9 | — | 45.1 | 88.2 | — |
| HP50W2 | 3.8 | 84.2 | 101.5 | 573.4 |
| HP-849 | — | — | 61.9 | — |
| HP-853 | — | — | 116.5 | — |
| HP-854 | — | — | 119.4 | — |
| HP-869 | 18.2 | 21.6 | 60.9 | — |

The results set forth in Tables V to VII for the Thermax alloys, are the highest values reported in Heyer, et al, U.S. Pat. No. 4,077,801.

Since it is desirable to know what design stresses may be estimated for years of service of high temperature alloys, estimates of rupture lives of 10,000 hours and 100,000 hours, about 1 year and 11 years respectively, are sometimes given in technical literature. It is obviously quite impractical to conduct tests of these lengths in experimental alloy development programs. However, it is well recognized that the relative performances of such alloys may be estimated with considerable confidence from stress rupture data of much shorter periods. The ASTM Standard E 139 test provides such data. For this reason, comparisons are often made on the basis of 1000-hour rupture lives. In creep rupture tests performed in air at high temperatures there is some deterioration of metal at and near the test bar surface over a period of time with consequent losses of properties in the affected depth. The true unit stress will therefore be somewhat higher than the calculated starting unit stress before any deterioration takes place. Also, as a typical metallic test bar deforms over time under stress at high temperature it lengthens and necks down to a smaller cross sectional area. The actual or true stress throughout most of the test period is therefore higher than the calculated stress determined from the beginning test bar dimensions.

The ASTM Standard E 139 rupture test provides for several different diameters of test bars. For equal unit stress values in undamaged test bars it may be seen from simple geometrical considerations that for a given depth of surface penetration a smaller diameter bar will have a larger actual unit stress after a long period of time than will a larger diameter bar with the same depth of surface penetration.

The test bar diameter employed by Heyer et al, (U.S. Pat. No. 4,077,801) in testing the Thermax alloys is not given but all other tests reported herein were conducted on ASTM E 139 ¼-inch diameter test bars and therefore represent comparative conditions. It may be seen that comparative alloy HP-838 conforms to alloys of the invention except for its high tungsten content. This alloy displays much shorter rupture life in all conditions than the alloys of the invention. Alloy HP-853 generally conforms to the alloy disclosed in Japan J60059-0JIA except as to zirconium content. Other comparative alloys similar to the invention, but not conforming in some way, all show variously shorter rupture lives than alloys of the invention.

EXAMPLE 2

Similar tests to those of Example 1 were conducted on alloys of the invention and on comparative alloys, all of the ACI HK-type. The results of these tests are set forth in Tables IX X, XI and XII. Almost invariable, for the same temperatures and stress levels, alloys of the invention gave much longer rupture lives than the base alloys. Comparative alloys 3001, 3002 and 3003 are from U.S. Pat. No. 4,861,547 and results listed are test data from that patent at a stress level of 500 psi at 1800° F. It is obvious that HK type alloys of the present invention are superior to those of the '547 patent. Alloy K-866 and HK-867 were made up in accordance with the TMA 4700 analysis given in the literature.

TABLE IX

| HK TYPE ALLOYS, HOURS TO FAILURE AT 1600° F. UNDER VARIOUS STRESSES | | | | |
|---|---|---|---|---|
| ALLOY | STRESS, P.S.I. | | | |
| NUMBER | 14,000 | 12,000 | 10,000 | 9,000 |
| HK-826 | — | 56.6 | 314.3 | 1130.1 |
| HK-837 | — | 83.2 | 389.7 | 1214.6 |
| HK-841 | — | 121.4 | — | — |
| HK-842 | — | 67.1 | 289.3 | — |
| HK-843 | — | 69.3 | 244.6 | — |
| HK-824 | 10.5 | — | 48.6 | — |
| HK-825 | 4.8 | — | 14.0 | — |
| HK-827 | — | — | 111.8 | — |
| HK-866 | — | 62.1 | — | — |
| HK-867 | — | — | 256.8 | — |
| THERMAX-HK | — | — | 228.0 | — |
| ACI-HK | — | — | 60.0 | 110.0 |

TABLE X

HK TYPE ALLOYS, HOURS TO FAILURE AT 1800° F. UNDER VARIOUS STRESSES

| ALLOY NUMBER | STRESS, P.S.I. 7,000 | 6,000 | 5,000 | 4,000 |
|---|---|---|---|---|
| HK-826 | — | 128.5 | 591.6 | — |
| HK-837 | — | 142.4 | 683.5 | — |
| HK-841 | — | 176.8 | — | — |
| HK-842 | — | 166.8 | — | — |
| HK-843 | — | 245.4 | 707.1 | — |
| HK-824 | 36.1 | 97.0 | 415.2 | — |
| HK-825 | 16.0 | 71.4 | 403.7 | — |
| HK-827 | — | 60.5 | 242.5 | — |
| HK-866 | — | 161.4 | 548.0 | — |
| HK-867 | — | 43.7 | 219.6 | — |
| THERMAX-HK | — | 197.0 | 230.0 | 1371.0 |
| ACI-HK | — | 40.0 | 80.0 | 220.0 |
| 3001 | — | — | 546.1 | — |
| 3002 | — | — | 364.4 | — |
| 3003 | — | — | 243.1 | — |

TABLE XI

HK TYPE ALLOYS, HOURS TO FAILURE 1900° F. UNDER VARIOUS STRESSES

| ALLOY NUMBER | STRESS, P.S.I. 5,000 | 4,000 | 3,000 |
|---|---|---|---|
| HK-826 | — | 355.3 | — |
| HK-837 | — | 391.6 | — |
| HK-841 | — | 297.2 | — |
| HK-842 | — | — | 1124.2 |
| HK-843 | 67.1 | — | — |
| HK-824 | 28.6 | 229.8 | — |
| HK-825 | 44.3 | 166.5 | — |
| HK-827 | — | 97.6 | — |
| HK-866 | — | 238.9 | — |
| HK-867 | — | 219.0 | — |
| THERMAX-HK | — | 175.0 | 992.0 |
| ACI-HK | — | 140.0 | 400.0 |

TABLE XII

HK TYPE ALLOYS, HOURS TO FAILURE AT 2000° F. UNDER VARIOUS STRESSES

| ALLOY NUMBER | STRESS, P.S.I. 4,000 | 3,500 | 3,000 | 2,500 |
|---|---|---|---|---|
| HK-826 | — | — | 354.6 | — |
| HK-837 | — | — | 486.5 | — |
| HK-841 | — | 124.0 | — | — |
| HK-842 | — | 147.6 | — | — |
| HK-843 | — | — | 254.8 | — |
| HK-824 | — | 90.6 | 169.8 | — |
| HK-825 | — | 38.8 | 92.4 | — |
| HK-827 | — | — | 56.6 | — |
| HK-866 | — | 74.4 | — | — |
| HK-867 | — | — | 162.1 | — |
| THERMAX-HK | — | — | — | — |
| ACI-HK | — | — | 30.0 | 60.0 |

EXAMPLE 3

Similar tests to those of Examples 1 and 2 were conducted on ACI HH-type test bars. One melt each of types HF and HN was also tested. The results of these tests along with those of several other miscellaneous alloy types are set forth in Tables XIII, XIV, XV, and XVI.

Test data at 5000 psi and 1800° F. for alloys 3010 and 3011 were taken as representative of alloys of U.S. Pat. No. 4,861,547 which are alloys of the HH type.

TABLE XIII

MISCELLANEOUS ALLOYS, HOURS TO FAILURE AT 1600° F. UNDER VARIOUS STRESSES

| ALLOY NUMBER | STRESS, P.S.I. 14,000 | 12,000 | 10,000 | 9,000 | 8,000 |
|---|---|---|---|---|---|
| HH-844 | — | — | 314.0 | — | — |
| HH-845 | — | — | 288.5 | — | — |
| HH-846 | — | 76.9 | — | — | — |
| HH-847 | — | — | 179.6 | — | — |
| HH-848 | — | 58.7 | — | — | — |
| HF-861 | — | — | — | 361.4 | 580.7 |
| HN-862 | — | — | — | 678.3 | — |
| H-871 | — | 176.9 | 605.0 | >1600 | — |
| H-873 | — | 126.5 | 365.8 | >1600 | — |
| ACI-HH | — | — | 10 | 20 | |
| ACI-HF | — | 1.7 | 6.3 | 15.4 | 37.6 |
| ACI-HN | — | — | 200 | 345 | 675 |
| CHSX-10 | 14.0 | — | 280.8 | — | — |
| 3010 | — | — | — | 614.2 | — |
| 3011 | — | — | — | 179.6 | — |
| U.S. Pat. No. 2,416,515 | — | — | — | 95 | 145 |
| N-155 | — | — | — | 351.2 | 614.1 |
| SUPERTHERM | 73.4 | 208.5 | 549.1 | 1110.5 | — |

TABLE XIV

MISCELLANEOUS ALLOYS, HOURS TO FAILURE AT 1800° F. UNDER VARIOUS STRESSES

| ALLOY NUMBER | STRESS, P.S.I. 7,000 | 6,000 | 5,000 | 4,000 |
|---|---|---|---|---|
| HH-844 | — | — | 289.3 | — |
| HH-845 | — | 359.3 | — | — |
| HH-846 | — | — | 488.6 | — |
| HH-847 | — | 387.2 | — | — |
| HH-848 | — | — | 521.4 | — |
| HF-861 | — | — | 187.9 | 618.4 |
| HN-862 | — | 324.6 | 948.2 | — |
| H-871 | — | 403.7 | 1492.8 | — |
| H-873 | — | 139.7 | 491.1 | — |
| ACI-HH | — | 15 | 25 | 50 |
| ACI-HF | 1 | 2 | 5 | 14 |
| ACI-HN | | 95 | 200 | 580 |
| 3010 | — | — | 414.6 | — |
| 3011 | — | — | 387.8 | — |
| U.S. Pat. No. 2,416,515 | — | 3 | 6 | 11 |
| H-807 | — | — | — | 192.4 |
| H-808 | — | — | — | 245.6 |
| Thermax-HN | — | 268 | — | 2070 |
| N-155 | — | 28.6 | 96.9 | 247.6 |
| SUPERTHERM | — | 219.1 | 548.1 | — |

TABLE XV

MISCELLANEOUS ALLOYS, HOURS TO FAILURE AT 1900° F. UNDER VARIOUS STRESSES

| ALLOY NUMBER | STRESS, P.S.I. 5,000 | 4,000 | 3,000 |
|---|---|---|---|
| HH-844 | — | 106.2 | — |
| HH-845 | 29.3 | — | — |
| HH-846 | — | — | 321.1 |
| HH-847 | — | 196.5 | — |
| HH-848 | 77.8 | — | — |
| HF-861 | — | 118.1 | — |
| HN-862 | — | 245.9 | 1343.2 |
| H-871 | 129.2 | 568.1 | 1765.8 |
| H-873 | 58.1 | 422.0 | 1195.2 |
| ACI-HH | 9 | 15 | 35 |
| ACI-HN | 24 | 65 | 260 |
| CHSX-10 | 52.1 | 206.4 | — |
| N-155 | 23.3 | 85.7 | 187.2 |
| SUPERTHERM | 106.1 | 339.6 | — |

TABLE XVI

MISCELLANEOUS ALLOYS, HOURS TO FAILURE AT 2000° F. UNDER VARIOUS STRESSES

| ALLOY NUMBER | STRESS, P.S.I. 5,000 | 4,000 | 3,000 |
|---|---|---|---|
| HH-844 | 25.4 | — | — |
| HH-845 | — | — | 82.1 |
| HH-846 | — | — | 85.6 |
| HH-847 | — | 48.2 | — |
| HH-848 | — | — | 91.3 |
| HF-861 | — | 91.7 | 224.9 |
| HN-862 | 71.8 | 259.1 | 564.3 |
| H-871 | 24.9 | 65.4 | 193.2 |
| H-873 | 8.9 | 39.8 | 124.6 |
| ACI-HH | — | 10 | 17 |
| ACI-HN | — | 100 | 140 |
| CHSX-10 | 50.0 | 122.4 | 195.4 |
| THERMAX-HN | — | — | 411 |
| U.S. Pat. No. 3,127,265 (SUPERTHERM) | 13.6 | 47.8 | 188.9 |
| N-155 | 5.1 | 15.6 | 36.2 |

Evans, U.S. Pat. No. 2,416,515, discloses molybdenum, tungsten, columbium and titanium additions to what is essentially the ACI HF base-type alloy. That alloy is listed in Tables XIII and XIV as U.S. Pat. No. 2,416,515. The reported data is from the '515 patent and the literature. The '515 alloy has greater rupture life than the HF-type alloy of the invention (HF-861) when tested at stress levels above about 12,000 psi but inferior rupture life at lower stresses. Since HF type alloys normally scale or oxidize severely at temperatures above about 1640° F., the '515 alloys have been employed only at temperatures below those at which most ACI type alloys are used. The HF-861 alloy of the invention showed superior rupture life in all of the test compared to '515 and did not oxidize nearly as severely as the latter at any temperature probably because of the rare earth component in its formulation. In a more practical range for this alloy, the '515 test bar ruptured at 519.3 hours 1600° and 6000 psi stress. Alloy HF-861 of the invention had not ruptured at 3000 hours under the same conditions.

The HN-862 alloy of the invention also provided much improved rupture life over standard ACI-type HN alloys. A comparison of the data also shows that although comparative alloy N-155 contains over 6% of four of the six critical elements of the invention (W, Cb, Mo, Ti, Zr and rare earth component) alloy HF-873, having the same base as N-155 and containing the critical elements in proportions within the ranges of the invention, has obviously far superior rupture life at various temperatures and loads.

Of the comparative alloys, the experimental alloy CHSX-10 compared well with both HH-type and HK-type alloys of the invention but at an enormously higher materials cost in view of containing 52% Ni, 37% Cr and 5% W.

EXAMPLE 4

A large proportion of the failures of heat resistant alloys occur either by thermal shock or by thermal fatigue. Good weldability of such alloys is also very desirable not only because of the common practice of cosmetic or structural repair of defects inherent to foundry production of many castings' designs, but also because of the assembling of some castings into larger assemblies by welding. Good ductility in these alloys is very important not only for weldability, but also for avoiding premature cracking by thermal shock or thermal fatigue.

The ACI alloys typically suffer significant loss of ductility after aging for some period at elevated temperature. Some of the grades have only about 10% to 13% room temperature elongation even prior to such aging. Attempts to improve their hot strengths by substantial additions or increases of some elements, such as cobalt and tungsten, further reduce ductility.

Some workers in this field seek to evaluate ductility of these alloys by aging for a period of time, such as 100 hours at 1450° F, and then testing at room temperature. Such tests correlate with field conditions since these alloys are normally put into service without heat treatment of any sort, and will age in actual service. The amount of elongation in stress rupture tests gives an indication of the abilities of these alloys to resist cracking during welding or in service involving thermal cycling. The ranges of elongations measured during the stress rupture testing of the various alloys types of the invention are set forth in Table XVII. Also included in the table are ranges of elongations of the similar standard ACI alloy types as determined from test bars taken from regular commercial heats of these alloys. For further comparison Table XVII also lists such values from stress rupture tests of a number of grades of jet engine type super alloys as well as from commercial heats of the alloy of U.S. Pat. No. 3,127,265, known by the tradename Supertherm. Ranges of elongations of the similar alloys of Heyer, et al, U.S. Pat. No. 4,077,801, sold under the tradename of Thermax, were taken from data in that patent. All tests were conducted after the test bars were aged at 1450° F. for 100 hours.

TABLE XVII

PERCENT ELONGATION IN STRESS RUPTURE TESTS AT VARIOUS TEMPERATURES

| Alloy | 1600° F. | 1800° F. | 1900° F. | 2000° F. |
|---|---|---|---|---|
| HP-Base | 20–87 | 18–66 | 22–38 | 14–36 |
| HK-Base | 18–37 | 17–32 | 17–28 | 15–34 |
| HH-Base | 16–32 | 22–40 | 20–34 | 12–31 |
| ACI HP | 1–11 | 1–28 | 9–31 | 12–34 |
| ACI HK | 3–10 | 2–15 | 5–20 | 8–20 |
| ACI HH | 1–5 | 1–22 | 1–11 | 1–3 |
| Thermax HP | 2–16 | 5–17 | 8–10 | 4–34 |
| Thermax HK | 5–14 | 1–31 | 4–9 | 10–16 |
| Thermax HH | 5–7 | 4–16 | — | — |
| Supertherm | — | 6–23 | — | 4–11 |
| Super alloys | 1–4 | 1–13 | 3–30 | 5–12 |

The alloys of the invention elongated considerably before rupture. These elongation values often corresponded to reductions in cross sectional area at the time of rupture of 50% to 94%; that is, the final cross sectional area at the necked down portion of the test bar ranged from about half to a mere 6% of the original area. These results demonstrate the exceptional abilities of the alloys of the invention to deform in service without rupturing despite their outstanding values of hot strength.

I have observed from experience with production heats of various types of heat resistant alloys that those of less than about 7% elongation, when tensile tested at room temperature, will present serious welding problems in many castings' configurations. Alloys of the invention have shown 8% to 27% tensile elongations at room temperature, depending upon base type.

To illustrate the advantages of employing the higher rare earth/misch metal contents in the instant alloys high, intermediate and low nickel/chromium alloys were prepared and were compared for their room temperature properties with standard alloys ACI-HF and ACI-HN, and Supertherm alloy. Analyses of all these alloys is set forth in Table XVIII below.

TABLE XVIII

| | Ni | Cr | Mo | W | Cb | Zr | Ti | REE[1] | Mn | Si | C | N |
|---|---|---|---|---|---|---|---|---|---|---|---|---|
| ACI-HF | 11.2 | 20.6 | — | — | — | — | — | — | .68 | .65 | .32 | .04 |
| XKB-5 | 11.3 | 20.8 | .26 | .47 | .28 | .21 | .18 | .04 | .73 | .66 | .31 | .06 |
| XKB-6 | 11.3 | 20.8 | .26 | .47 | .28 | .21 | .18 | .06 | .73 | .66 | .31 | .06 |
| XKB-7 | 11.3 | 20.8 | .26 | .47 | .28 | .21 | .18 | .13 | .73 | .66 | .31 | .06 |
| XKB-8 | 11.3 | 20.8 | .26 | .47 | .28 | .21 | .18 | .21 | .73 | .66 | .31 | .06 |
| Supertherm[2] | 35.7 | 28.1 | — | 5.06 | — | — | — | — | .36 | .67 | .51 | .09 |
| H-871[3] | 35.3 | 28.0 | .15 | .78 | .43 | .19 | .21 | .06 | .64 | .78 | .44 | .02 |
| H-880[4] | 35.7 | 27.7 | .16 | .72 | .39 | .21 | .19 | .13 | .66 | .58 | .47 | .14 |
| ACI-HN | 25.3 | 21.2 | — | — | — | — | — | — | .86 | .73 | .45 | .06 |
| H-877 | 25.1 | 21.5 | .19 | .56 | .37 | .21 | .19 | .07 | .47 | .81 | .45 | .09 |
| H-878 | 25.1 | 21.0 | .21 | .54 | .46 | .20 | .21 | .23 | .52 | .74 | .47 | .07 |

[1]REE = rare earth elements. Amount reported is 1.33 times the determined amount of Ce + La.
[2]Also contains 15.10% Co.
[3]Also contains 14.5% Co.
[4]Also contains 15.2% Co.

TABLE XIX

| | TENSILE STRENGTH PSI | YIELD STRENGTH PSI | % ELONGATION | BRINNEL HARDNESS NUMBER | RUPTURE LIFE 9000 PSI 1600 F. |
|---|---|---|---|---|---|
| ACI-HF | 76,800 | 35,800 | 25.2 | 165 | 15.4 |
| XKB-5 | 79,900 | 36,300 | 10.5 | 179 | 114.8 |
| XKB-6 | 80,600 | 38,200 | 16.5 | 179 | 173.2 |
| XKB-7 | 83,800 | 40,100 | 28.5 | 179 | 368.3 |
| XKB-8 | 89,900 | 43,900 | 41.0 | 179 | 549.2 |
| Supertherm | 69,100 | 48,900 | 6.0 | 195 | 1110.5 |
| H-871 | 70,300 | 39,500 | 6.0 | 192 | 1207.2 |
| H-880 | 79,300 | 51,700 | 14.0 | 192 | 3172.3 |
| ACI-HN | 68,000 | 38,000 | 10.0 | 181 | 345 |
| H-877 | 63,900 | 36,300 | 10.5 | 179 | 626.6 |
| H-878 | 89,300 | 43,800 | 38.6 | 179 | 1493.8 |

From the data set forth in TABLE XIX it is evident that the addition of large amounts of misch metal gave higher room temperature elongations as well as improved rupture life compared to the parent alloys not of the alloys of the invention as well as to alloys of the invention containing lower amounts of misch metal.

The foregoing description of the several embodiments of the invention is not intended as limiting of the invention. As will be apparent to those skilled in the art variations and modifications of the invention may be made without departure from the spirit and scope of this invention.

What is claimed is:

1. A castable heat resistant alloy consisting essentially of, by weight:

Nickel: about 8% to about 62%
Chromium: about 12% to about 32%
Molybdenum: about 0.05% to about 0.8%
Tungsten: about 0.2% to about 0.95%
Columbium: about 0.05% to about 0.6%
Zirconium: about 0.05% to about 0.8%
Titanium: about 0.05% to about 0.45%
Rare Earth Component: about 0.04% to about 0.40%
Carbon: up to about 0.8%
Nitrogen: up to about 0.4%
Silicon: up to about 3%
Vanadium: up to about 0.3%
Manganese: up to about 3%
Cobalt: up to about 25%
Boron: up to about 0.05%
Iron: essentially balance

2. An alloy of claim 1 wherein:

Molybdenum: about 0.08% to about 0.6%
Tungsten: about 0.20% to about 0.70%
Columbium: about 0.15% to about 0.50%
Zirconium: about 0.08% to about 0.60%
Titanium: about 0.08% to about 0.30%
Rare Earth: about 0.05% to about 0.15%
Component.

3. An alloy of claim 1 wherein:

Molybdenum: about 0.08% to about 0.25%
Tungsten: about 0.30% to about 0.50%
Columbium: about 0.15% to about 0.25%
Zirconium: about 0.08% to about 0.25%
Titanium: about 0.08% to about 0.20%
Rare Earth Component: about 0.05% to about 0.15%

4. An alloy of claim 1 wherein:

Nickel: about 21% to about 26%
Chromium: about 22% to about 26%

5. An alloy of claim 1 wherein:

Nickel: about 22% to about 36%
Chromium: about 23% to about 28%
Cobalt: about 14% to about 19%

6. An alloy of claim 2 wherein:

Nickel: about 36% to about 38%
Chromium: about 23% to about 24%

7. An alloy of claim 2 wherein the proportion of nickel is about 12% and the proportion of chromium is about 21%.

8. An alloy of claim 2 wherein the proportion of nickel is from about 13% to about 15% and the proportion of chromium is about 23% to about 25%.

9. An alloy of claim 3 wherein the proportion of nickel is from about 36% to about 38% and the proportion of chromium is from about 23% to about 24%.

10. A master alloy suitable for improving the heat resistant properties of nickel-chromium-iron alloys consisting essentially of, by weight:

Tungsten: about 12% to about 51%

Columbium: about 6% to about 27%
Zirconium: about 4% to about 25%
Titanium: about 4% to about 15%
Rare Earth: about 3% to about 14%
Component
Residuals: up to about 58% optionally containing about 6% to about 21% molybdenum, wherein the elements of such residuals are selected from nickel, iron, chromium, columbium, manganese, silicon, carbon, tantalum, sulfur, phosphorus, aluminum, calcium, magnesium, copper, vanadium, tin, lead, bismuth, barium, nitrogen, oxygen, thallium, tellurium, selenium, antimony and molybdenum, and mixtures thereof, provided that, when present, the amount of each element of such residuals other than nickel and iron does not exceed about 1/10% by weight of said master alloy, said alloy having a density of at least about 8.1 gm/cc.

11. A master alloy of claim 10 wherein:
Molybdenum: about 4% to about 10%
Tungsten: about 12% to about 24%
Columbium: about 6% to about 11%
Zirconium: about 4% to about 10%
Titanium: about 4% to about 6%
Rare Earth: about 3% to about 17%
Component
Balance residuals said alloy having a density of about 8.16 to about 8.8 gm/cc.

12. A master alloy of claim 11 wherein:
Molybdenum: about 4% to about 10%
Tungsten: about 13% to about 22%
Columbium: about 7% to about 11%
Zirconium: about 4% to about 9%
Titanium: about 4% to about 6%
Rare Earth: about 10% to about 18%
Component
Balance residuals said alloy having a density of about 8.4 to about 9.0 gm/cc.

13. A master alloy of claim 12 wherein:
Molybdenum: about 4% to about 7%
Tungsten: about 15% to about 18%
Columbium: about 7% to about 10%
Zirconium: about 4% to about 7%
Titanium: about 4% to about 6%
Rare Earth: about 11% to about 16%
Component
Residuals: about 36% to about 55% said alloy having a density of about 8.5 to about 9.0 gm/cc.

14. A master alloy of claim 13 wherein the proportions are:
Molybdenum: about 6%
Tungsten: about 15%
Columbium: about 9%
Zirconium: about 5%
Titanium: about 5%
Rare Earth: about 15%
Component
Iron: about 45%

15. A master alloy of claim 10 wherein:
Tungsten: about 16% to about 26%
Columbium: about 7% to about 13%
Zirconium: about 4% to about 12%
Titanium: about 4% to about 8%
Rare earth: about 3% to about 20%
Component
Balance residuals said alloy having a density of about 8.15 to about 8.4 gm/cc.

16. A master alloy of claim 15 wherein:
Tungsten: about 14% to about 21%
Columbium: about 8% to about 12%
Zirconium: about 4% to about 10%
Titanium: about 4% to about 9%
Rare earth: about 14% to about 21%
Component
Balance residuals said alloy having a density of about 8.3 to about 9.0 gm/cc.

17. A master alloy of claim 16 wherein:
Tungsten: about 16% to about 19%
Columbium: about 8% to about 11%
Zirconium: about 4% to about 8%
Titanium: about 4% to about 8%
Rare Earth: about 16% to about 19%
Component
Residuals: about 35% to about 52% said alloy having a density of about 8.3 to about 8.8 gm/cc.

18. A master alloy of claim 17 wherein the proportions are:
Tungsten: about 18%
Columbium: about 9%
Zirconium: about 5%
Titanium: about 5%
Rare Earth: about 15%
Component
Nickel: about 48%

19. A master alloy of claim 10 wherein:
Molybdenum: about 8% to about 21%
Tungsten: about 24% to about 47%
Columbium: about 10% to about 23%
Zirconium: about 9% to about 21%
Titanium: about 8% to about 13%
Rare Earth: about 5% to about 35%
Component
Balance residuals said alloy having a density of about 8.4 to about 9.8 gm/cc.

20. A master alloy of claim 19 wherein:
Molybdenum: about 9% to about 21%
Tungsten: about 28% to about 44%
Columbium: about 14% to about 23%
Zirconium: about 9% to about 18%
Titanium: about 8% to about 12%
Rare Earth: about 20% to about 36%
Component
Balance residuals said alloy having a density of about 8.5 to about 9.5 gm/cc.

21. A master alloy of claim 20 wherein:
Molybdenum: 9% to 14%
Tungsten: 29% to 32%
Columbium: 14% to 16%
Zirconium: 9% to 13%
Titanium: 8% to 12%
Rare Earth: 23% to 27%
Component
Balance residuals said alloy having a density of about 8.5 to about 8.8 gm/cc.

22. A master alloy of claim 21 wherein the proportions are:
Molybdenum: about 10%

Tungsten: about 30%
Columbium: about 15%
Zirconium: about 10%
Titanium: about 10%
Rare Earth: about 25%
Component
Balance residuals

23. A master alloy of claim 10 wherein:
Tungsten: about 30% to about 51%
Columbium: about 13% to about 27%
Zirconium: about 9% to about 25%
Titanium: about 9% to about 15%
Rare Earth: about 7% to about 40%
Component
Balance residuals
said alloy having a density of about 8.18 to about 9.6 gm/cc.

24. A master alloy of claim 23 wherein:
Tungsten: about 28% to about 42%
Columbium: about 16% to about 25%
Zirconium: about 9% to about 20%
Titanium: about 9% to about 14%
Rare Earth: about 28% to about 40%
Component
Balance residuals
said alloy having a density of about 8.3 to about 9.3 gm/cc.

25. A master alloy of claim 24 wherein:
Tungsten: about 33% to about 35%
Columbium: about 16% to about 18%
Zirconium: about 9% to about 11%
Titanium: about 9% to about 13%
Rare Earth: about 27% to about 29%
Component
Residuals: about 3% to about 6%
said alloy having a density of about 8.3 to about 8.7 gm/cc.

26. A master alloy of claim 25 wherein the proportions are:
Tungsten: about 33%
Columbium: about 17%
Zirconium: about 9%
Titanium: about 11%
Rare Earth: about 27%
Component
Balance residuals

27. A castable heat resistant alloy consisting essentially of, by weight:
Nickel: about 8% to about 62%
Chromium: about 12% to about 32%
Iron: essentially balance
Carbon: up to about 0.8%
Nitrogen: up to about 0.4%
Silicon: up to about 3%
Vanadium: up to about 0.3%
Manganese: up to about 3%
Cobalt: up to about 25%
Boron: up to about 0.05%
and from about 0.4% to 7.9% of a master alloy of claim 10.

28. An alloy of claim 27 wherein the amount of the master alloy of claim 10 is from about 0.6% to about 4.2%.

29. A method of making an alloy of claim 1 which comprises adding to an alloy melt consisting of, by weight:
Nickel: about 8% to about 62%
Chromium: about 12% to about 32%
Carbon: up to about 0.8%
Nitrogen: up to about 0.4%
Silicon: up to about 3%
Vanadium: up to about 0.3%
Manganese: up to about 3%
Cobalt: up to about 25%
Boron: up to about 0.05%
Iron: essentially balance
from about 0.4% to about 7.9% of a master alloy of claim 10.

* * * * *